US005733211A

United States Patent [19]

Dupre

[11] Patent Number: 5,733,211

[45] Date of Patent: Mar. 31, 1998

[54] COIN-OPERATED TABLE TENNIS TABLE

[76] Inventor: Ronald Dupre, 1159 Highland Ave, Waterbury, Conn. 06708

[21] Appl. No.: 804,563

[22] Filed: Feb. 24, 1997

[51] Int. Cl.[6] ..... A63B 67/24

[52] U.S. Cl. ..... 473/496

[58] Field of Search ..... 473/496, 491, 473/494, 113

[56] References Cited

U.S. PATENT DOCUMENTS

| | | | |
|---|---|---|---|
| 2,632,546 | 3/1953 | Mott | 473/496 X |
| 3,777,674 | 12/1973 | Parsons | 473/496 X |
| 3,817,519 | 6/1974 | Leonhart | 473/496 |
| 3,823,938 | 7/1974 | Unno | 473/496 |
| 4,089,522 | 5/1978 | Rock | 473/496 X |
| 4,907,803 | 3/1990 | Van Anda | 473/496 |

FOREIGN PATENT DOCUMENTS

| | | | |
|---|---|---|---|
| 2623093 | 5/1989 | France | 473/113 |

*Primary Examiner*—Raleigh W. Chiu
*Attorney, Agent, or Firm*—Dallett Hoopes

[57] ABSTRACT

Vertically-moving frame operates in a slot at the net line of a table tennis table. The top of the frame preferably carries the net. When the frame is down, the net is in the usual playing position. When the time is up, the frame is raised, forming a barrier to further play.

13 Claims, 9 Drawing Sheets

COIN-OPERATED TABLE TENNIS TABLE

FIELD OF THE INVENTION

This invention relates to a table tennis table having a barrier to selectively prevent play. More specifically, the invention relates to a table tennis table wherein the barrier comprises a vertical frame adapted to reciprocate vertically at the net line in the center of the table. The lowering of the barrier may be coin- or paper-money-operated.

BACKGROUND OF THE INVENTION

The prior art includes a number of patents disclosing coin-operated table tennis tables. The Leonhart U.S. Pat. No. 3,817,519 granted Jun. 18, 1974, features sleeves extending above the table tennis playing surface to block play until money is inserted into the pay slot. If an attempt is made to unlawfully jamb the sleeves down, pins within the sleeves rise to prevent play despite the unauthorized lowering of the sleeves.

The Mott U.S. Pat. No. 2,632,546 granted Mar. 24, 1953, discloses a table tennis table in which the net pivots down flat against the table surface until a coin is inserted, after which solenoid means elevate the net to normal vertical position. The Netherlands patent 39,165 of Oct. 15, 1936 also discloses a coin-operated table in which the net is pivoted down flat against the table until a coin is inserted.

The French patent 2,623,093 of May 19, 1989 discloses a table tennis table in which means hold the table in tilted position making it unplayable until a coin is inserted in the coin-receiving housing. Another patent having means to tilt the table top is Vananda U.S. Pat. No. 4,907,803.

There has been a need for a simple coin-operated table tennis table in which a barrier to play is raised in the center of the table until a coin is inserted. The need has also required fool-proof means for locking the barrier in the upper position so that the coin-operated feature cannot be circumvented.

SUMMARY OF THE INVENTION

The invention is a selectively play-preventing table tennis table comprising a table surface having a slot across the center thereof at the usual net position, legs supporting the table, and a vertically disposed frame adapted to vertically reciprocate in the slot. A control housing is provided under the table including a drive engaging the frame to lower the frame, putting the net in playing position or to raise the frame, making it a barrier. The invention also includes an actuating circuit for the drive. The actuating circuit may be coin-operated.

The playing net may be mounted on the top of the frame.

BRIEF DESCRIPTION OF THE DRAWINGS

Further objects and features of the invention will be apparent from a study of the specification with reference to the drawings, all of which disclose a non-limiting embodiment of the invention. In the drawings.

DESCRIPTION OF THE PREFERRED EMBODIMENT

Figure 1:
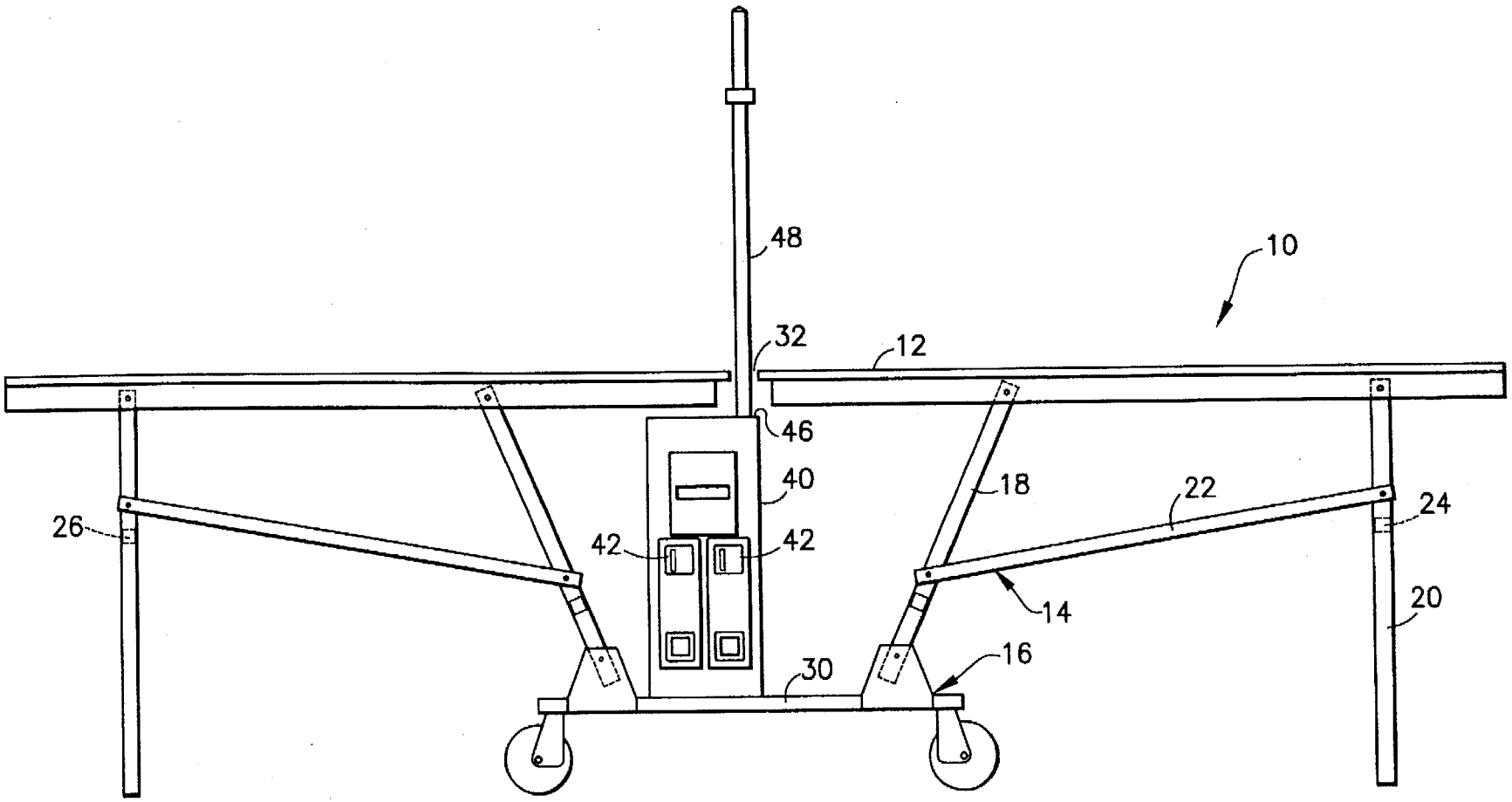
FIG. 1 is a side view of a table tennis table embodying the invention.
Figure 3:
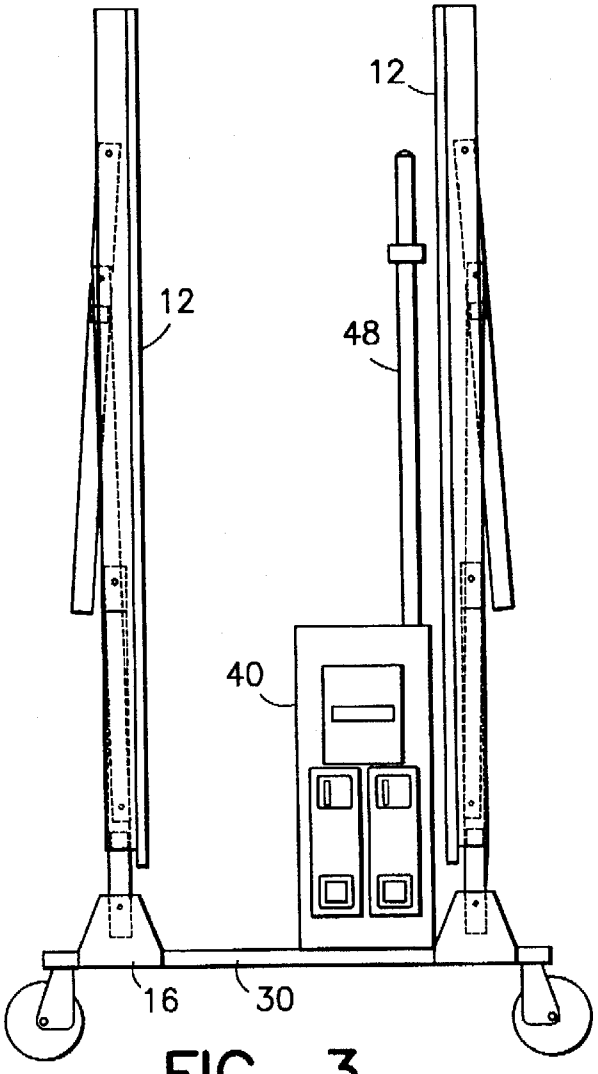
FIG. 3 is a view similar to FIG. 2 but showing the control box shifted to the right and the left side of the table pivoted up in full storage position.

A table tennis table embodying the invention is shown in FIG. 1 and generally designated 10. It comprises a table surface 12 and legs generally designated 14. The table shown is of the type available from a number of manufacturers. One table is available from Esclade Sports of Evansville, Ind., sold as the Stiga outdoor roller.

The legs 14 may comprise a wheeled platform 16 pivoted from the opposite sides of which are supporting struts 18 pivoted to the table. The legs also comprise the conventional pairs of vertical end legs 20 pivoted to the underside of the table top.

For each of the four struts and four legs, a connecting link 22 is pivoted to the strut 18 and the vertical leg 20 to keep them in proper relation as the table is folded. The legs and struts of each pair are connected by crosspieces 24 and 26 so that each half of the table top surface is supported independently of the other half except for the common attachment of the struts 18 to the wheeled platform 16. Aside from the wheels, the wheeled platform 16 comprises the parallel rails 30. (it will be understood that only the forward elements of the legs are shown, identical elements are aligned behind them.) In the usual arrangement, the playing net is attached to the table surface 12 and is disposed across the center of the length of the table. In a table embodying the invention the usual slot or crack between the two table halves at the net line is enlarged to comprise a slot 32 (FIG. 1). Otherwise the table is precisely the same as that commercially available except for the addition of the frame and control housing to be described.

Figure 2:
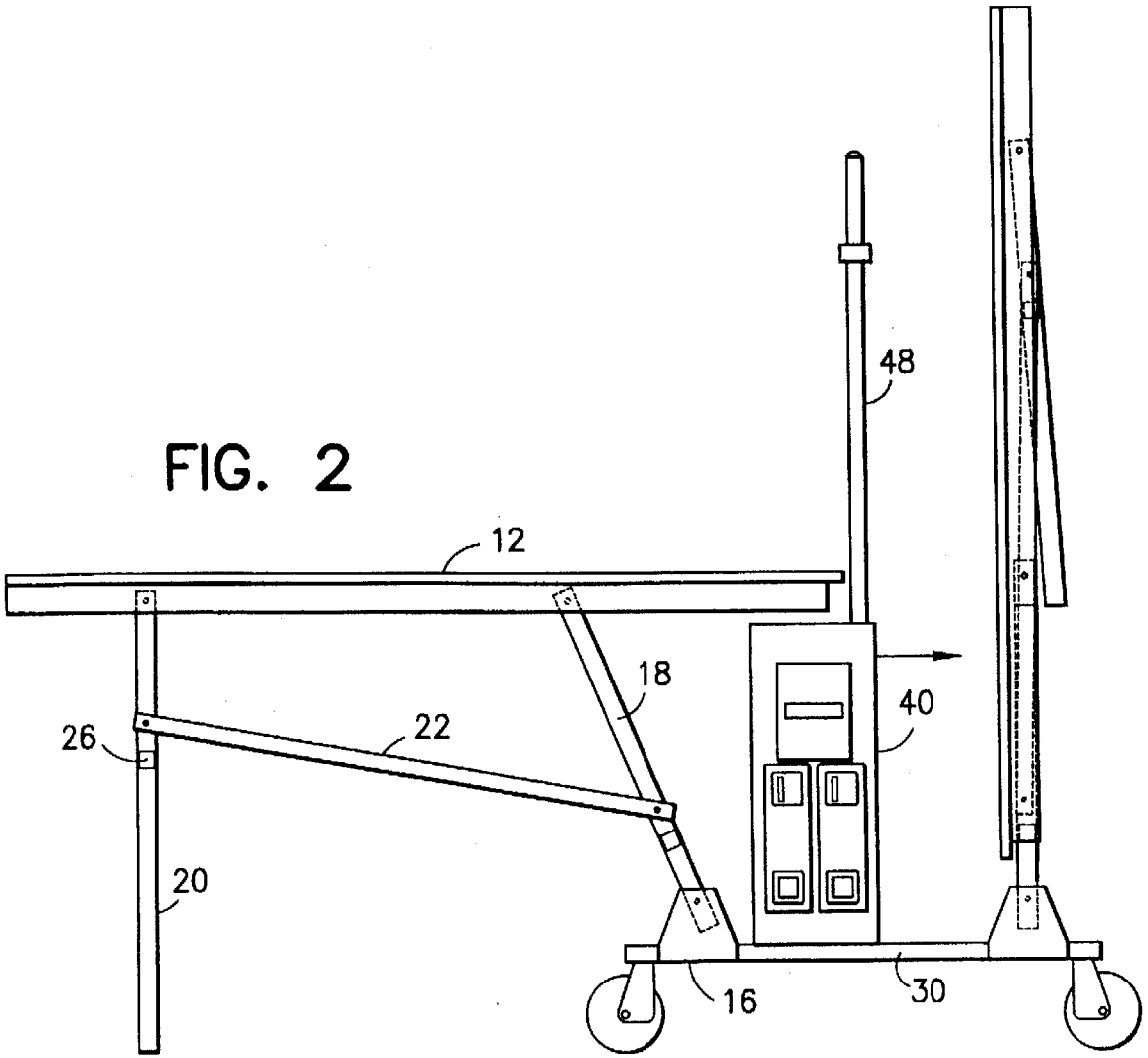
FIG. 2 is a view similar to FIG. 1 but showing the right side of the table pivoted up in preparation for storage.

As shown, the control housing 40 for the net is a generally rectangular box, the opposite ends of which are slidably supported on the rails 30. Mounted on the side of the box (FIG. 2) are the coin-receiving mechanism 42 and behind that the electrical circuitry wiring. The upper wall of the control housing is formed with an elongated opening 46.

Vertically disposed for vertical reciprocation in the opening 46 is the frame 48. The frame is generally rectangular (FIG. 2) and includes the two vertical rails 50 and 52.

Connecting these two elements is the horizontal crosspiece 54 which serves as a support for the net 56 and which, when the frame is down, nestles into the slot 32. The frame also includes lower cross elements 58 and 60. Thus, the frame is a rigid unit operating in the control housing 40 through the opening 46 and extending through the slot 32 in the center of the table. The frame is preferably covered by a solid panel thereacross. The panel may bear advertising. Guides for the rails 50, 52 are supported in the housing, but to avoid complicating the drawing, are not shown.

Figure 4:
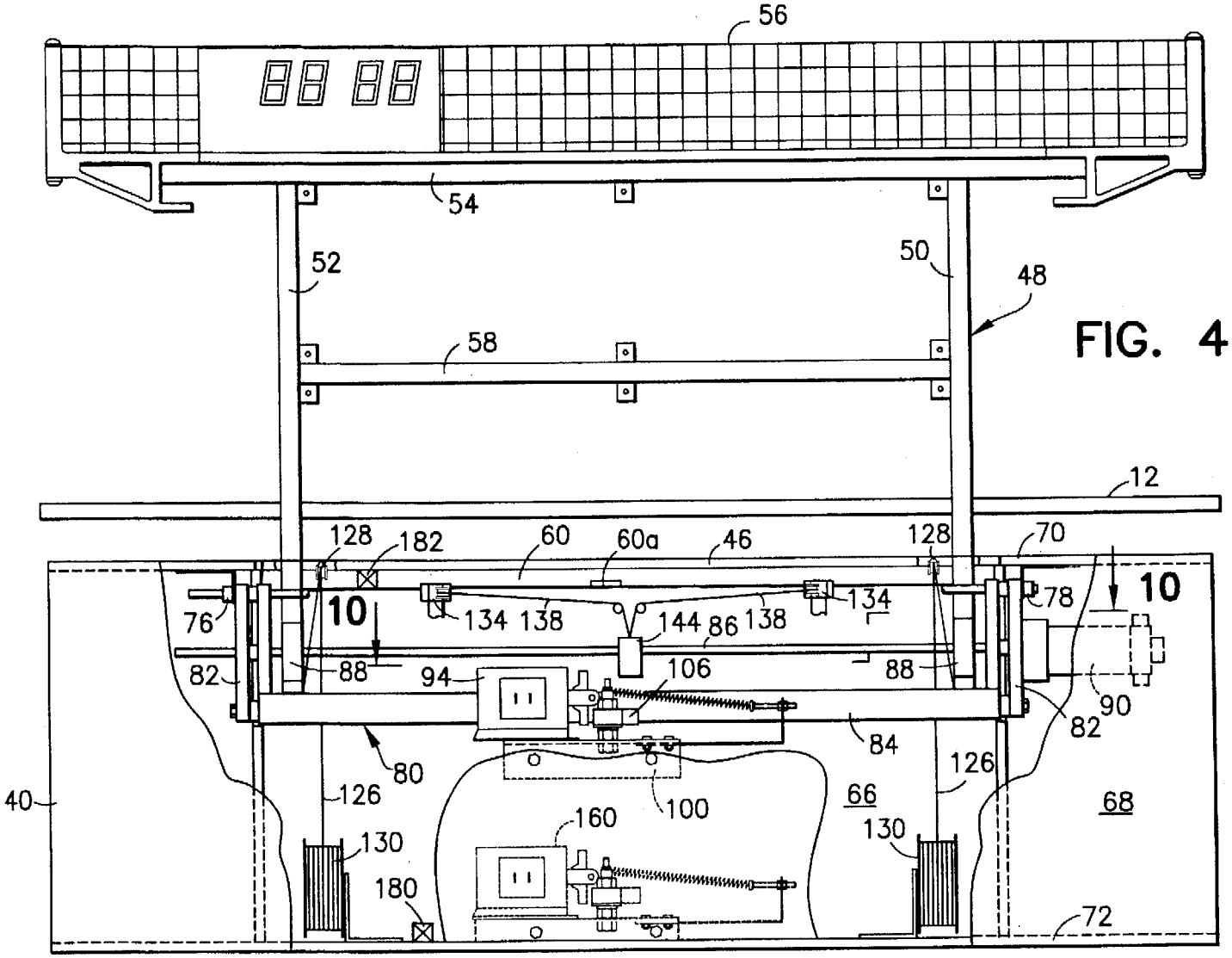
FIG. 4 is a front elevation of the control housing with its cover partly broken away to show the components therein, partly in phantom and showing the frame in the play-preventing up position.
Figure 5:
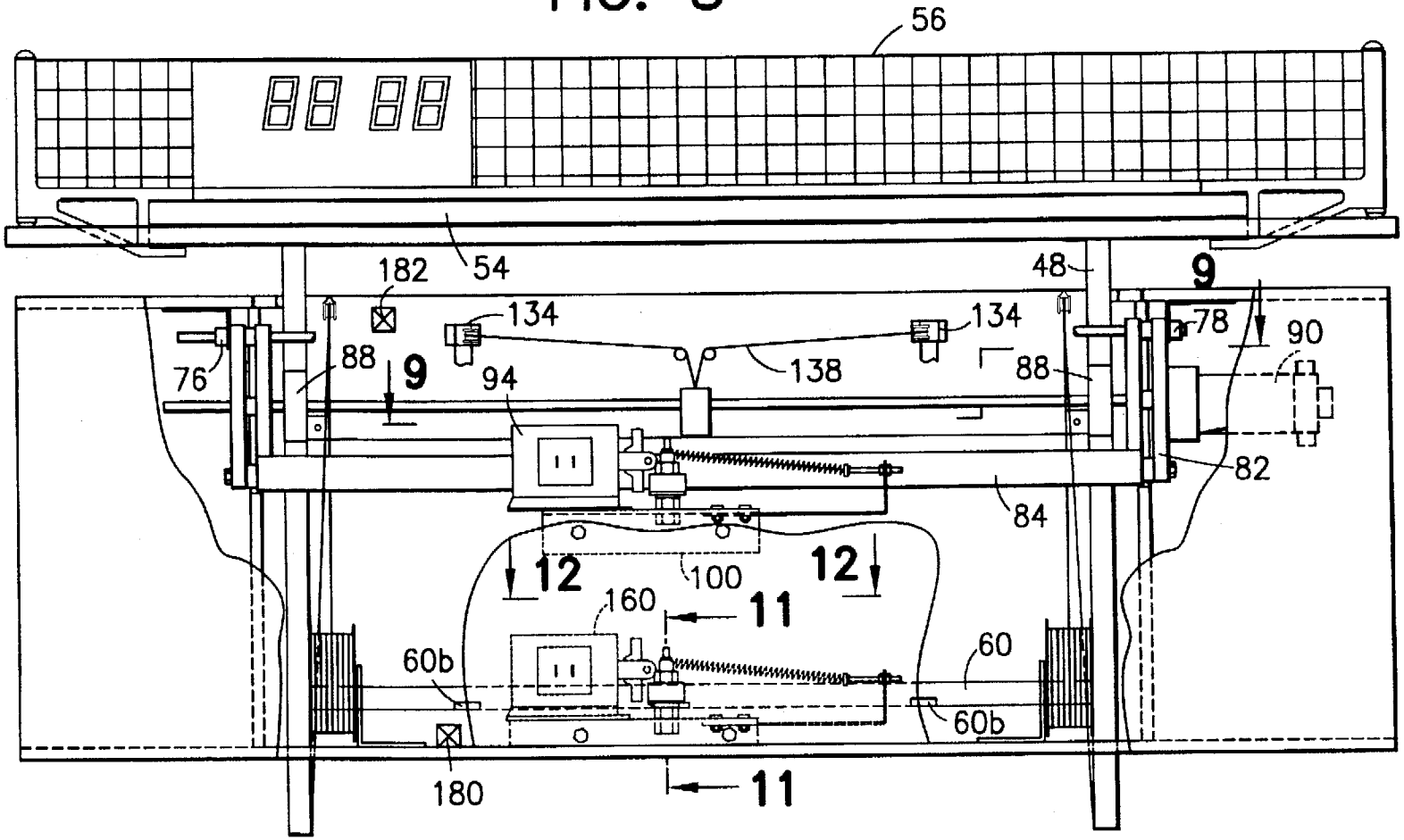
FIG. 5 is a view similar to FIG. 4 with the frame in the play-permitting down position.

The rectangular control housing is defined by vertical parallel front and rear support walls 66 and 68 (FIG. 4). Between them are an appropriately apertured top wall 70, which may be removable, and side walls and bottom wall 72. Front wall 68 (FIG. 1) supports some of the control mechanisms, and portions of the top wall 70 support brackets which carry support journals 76, 78. Pins pivoted in the journals respectively support a broad U-shaped drive support 80. The drive support is free to hang and swing about its pins which ride in the journals 76, 78. The U-shaped report comprises the opposite end plates 82 and the horizontal element 84 which has a generally flat front face.

Journaled in the side plates 82 is a drive shaft 86 on which is mounted a pair of drive wheels 88 which are aligned with the side elements 50, 52 of the frame 48. A reversible electric drive motor 90 is secured on the rightward side plate 82 (FIG. 4) and is connected to the shaft 86 through the side plate so that the motor 90 rotates the wheels 88 in driving fashion.

Figure 8:
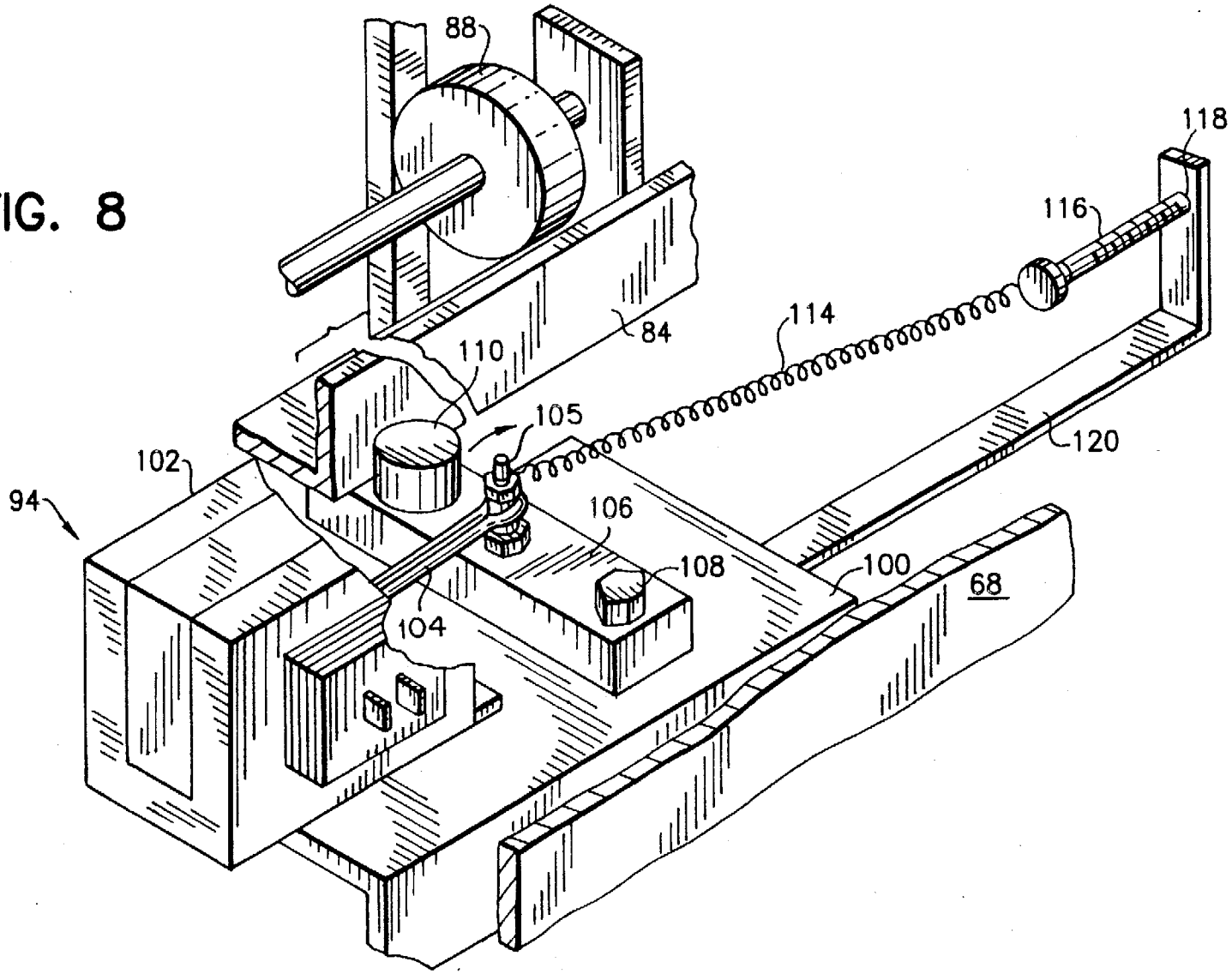
FIG. 8 is an enlarged fragmentary perspective view of part of the mechanism which engages the drive with the frame. Part of the drive solenoid is broken away to show the drive better.

A normal position of the broad U-shaped yoke 80 is generally vertical, that is, hanging from its pivot pins on the journals 76, 78. In this position the wheels 88, which may be rubber, are spaced from the side elements 50, 52 of the frame 48. A drive-engaging mechanism 44 (FIG. 8) is mounted on the front wall 68 of the control box.

Figure 10:
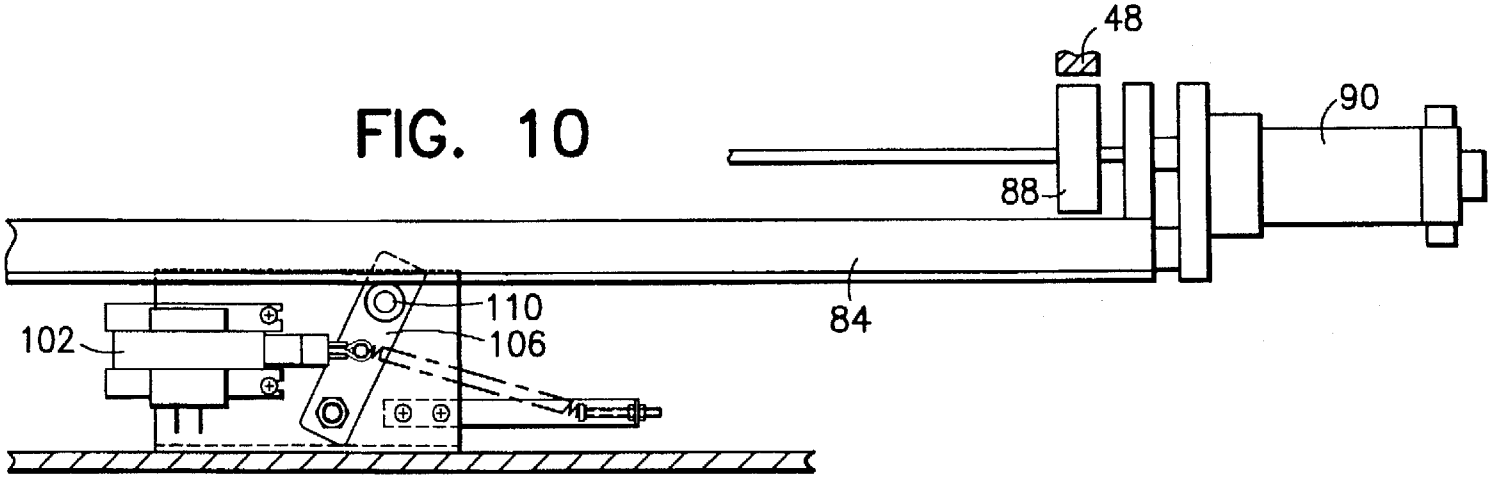

The mechanism 94 includes bracket 100 mounting a solenoid 102, the armature 104 of which is pivotally attached to a pin 105 on an engaging arm 106. At one end the engagement arm is pivoted as by bolt 108 to the mechanism bracket 100. On the other side from the pivot bolt 108 the engaging arm 106 is provided with a shoe 110 which is aligned with the horizontal member 84 of the broad yoke 80. The pin 105 of the engaging arm 106 mounts one end of a helical spring 114, the other end of which is secured to a thumb screw 116 engaged in a tapped opening 118 in an extension 120 of the bracket 100. By this means the engagement arm 106 is adjustably biased away from the solenoid 102 (FIG. 10).

Figure 9:
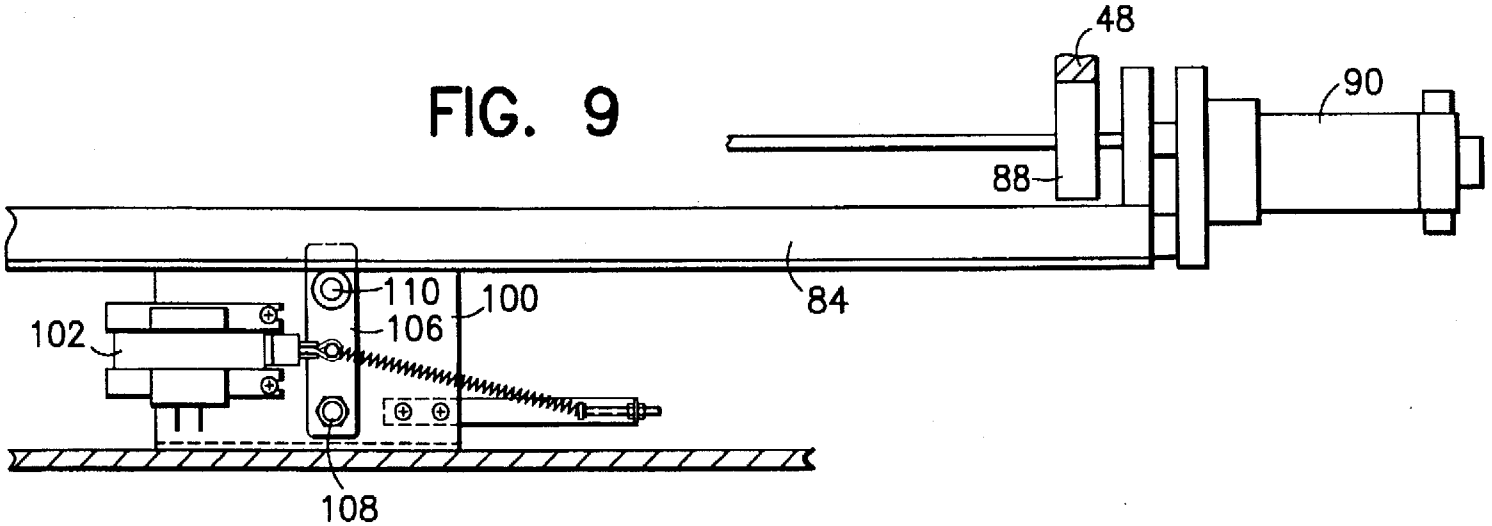
FIGS. 9 and 10 are reduced fragmentary side views taken on the line 10—10 of FIG. 4 of the mechanism of FIG. 8 and related parts and showing the mechanism first (FIG. 9) with the drive in engaged position and then FIG. 10) in disengaged position.

Upon actuation of the solenoid 102, the arm 106 slams toward the engaged position, the shoe 110 pushing the horizontal member 84 toward the frame 48 (FIG. 9). This enables the wheels 88 to frictionally engage the side elements 50, 52 (FIG. 4). In this engaged position the actuation of the motor 90 in the forward or reverse direction will raise or lower the frame 48 and net 56.

To bias the frame in the upward play-preventing position, the frame has attached to its spaced lower ends—that is, the lower ends of side elements 50, 52—the respective ends of cables 126 which are trained upwardly over pulleys 128 mounted on the wall 66, and downwardly to the respective spring-biased cable drums 130. The result of this arrangement is that when power fails, the drums 130 wind up the cable 126 to raise the frame 48 and net 56 to the play-preventing position. In normal course the frame and net are driven up by the reversible motor 90.

Figure 6:
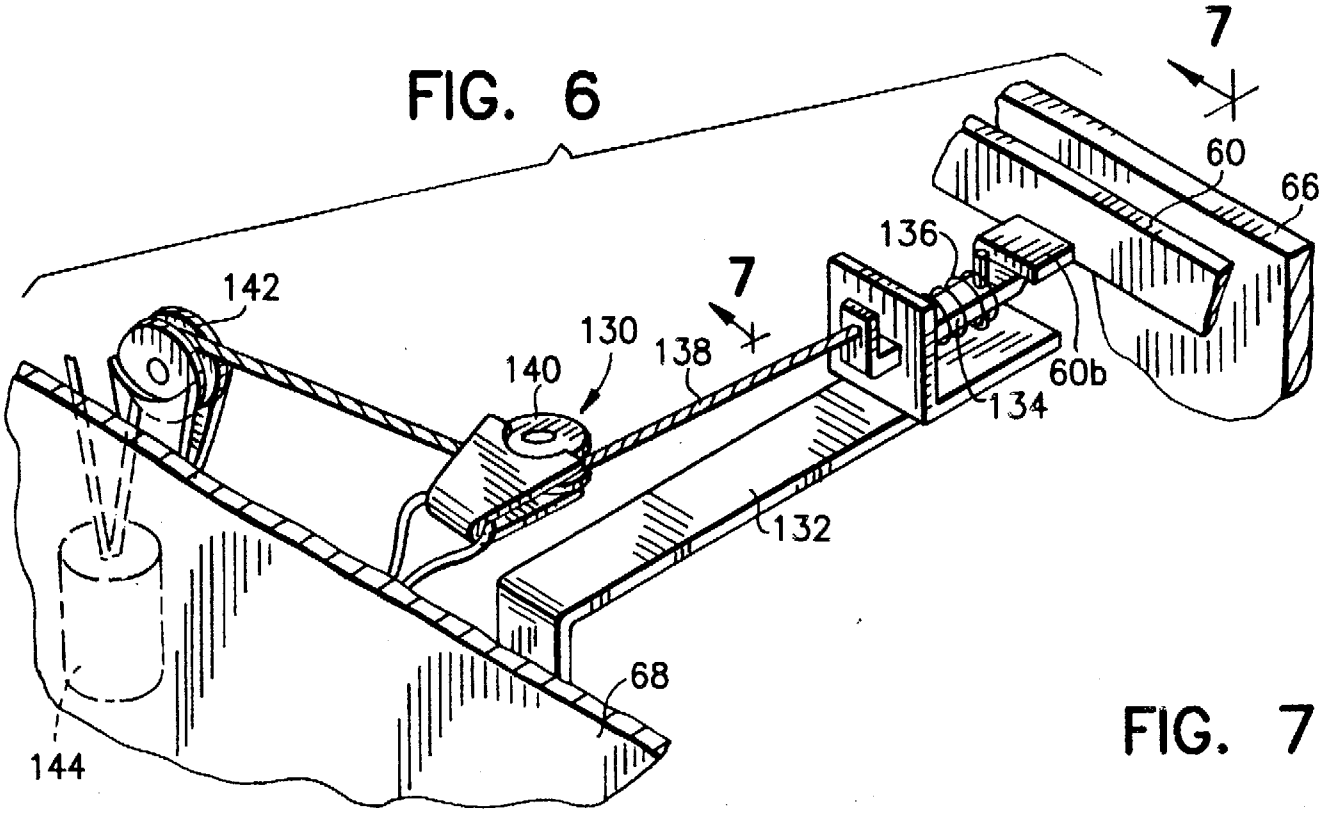
FIG. 6 is an enlarged fragmentary perspective view of part of the mechanism which locks the frame in the up position.
Figure 11:
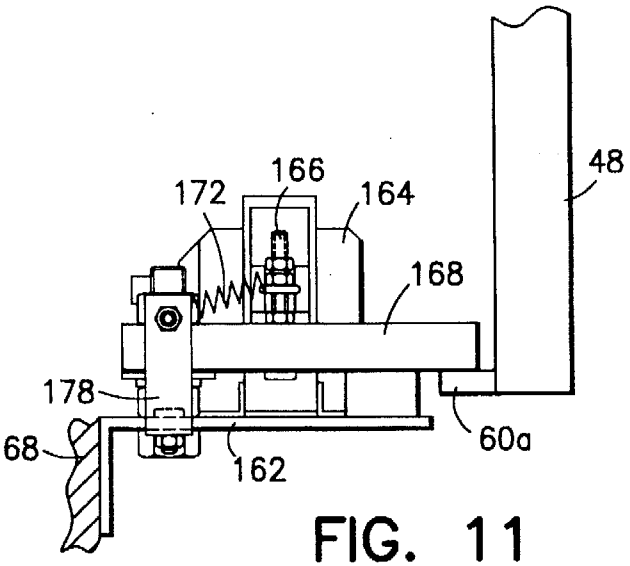
FIG. 11 is a fragmentary side elevation of the mechanism for locking down the frame.
Figure 12:
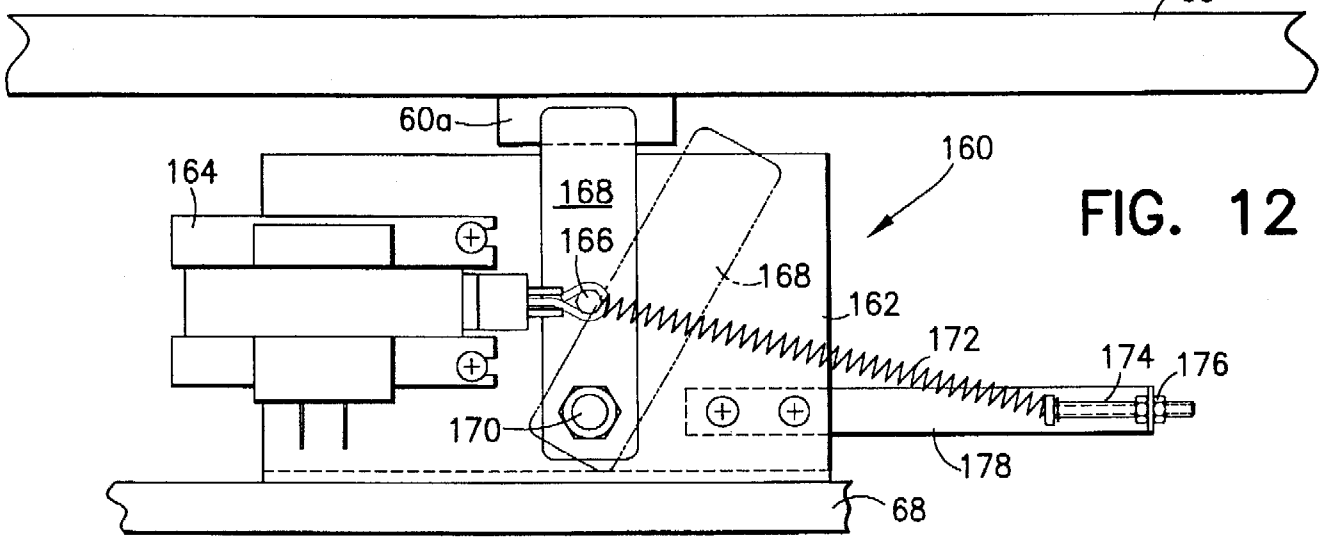
FIG. 12 is an enlarged top view of the mechanism of FIG. 11 showing the mechanism in locked position and in phantom in unlocked position.

To assure that the net and frame remain in the respective play-preventing or play-permitting positions, there is provided an upper latching mechanism 130 (FIGS. 6 and 7) and a locking down mechanism 160 (FIGS. 11 and 12).

Figure 7:
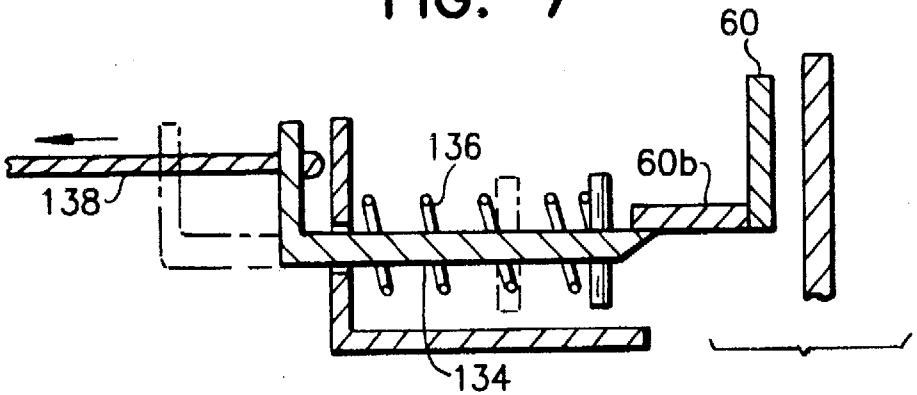
FIG. 7 is a sectional view taken on the line 7—7 of FIG. 6.

The upper latching mechanism 130 comprises a bracket 132 mounted on the wall 68 and having at its distal end a spring-biased latch 134 biased in the outward position and adapted to give way for the cross element 60 with its integral dog **60*b* as frame rises. The forward end of the latch bolt (not shown) is bevelled so that the latch bolt moves inward against the bias of spring 136 to permit the cross element 60 to pass and then snaps outward blocking the lowering of the frame (FIG. 7). The purposeful withdrawal of the latch is subsequently effected by a cable 138 (FIG. 6) secured to the rear end of the latch. The cable passes over pulleys 140, 142 suitably mounted on the wall 68 to the armature of a solenoid 144 shown in phantom in FIG. 6**.

In order to assure that both ends of the frame are held up, two such latches are provided, and the cables 138 are each joined to the armature of the solenoid 144 whereby the solenoid can, when activated, withdraw both latches 134 to disengage the cross element 60. This permits the dropping down of the frame 48. It will be seen that even if there should be a power failure, the arrangement described will assure that the frame is held up in the non-playing position until there is an authorized lowering of the frame and net as by the insertion of a coin.

To assure that the frame and net are held down during the authorized play-permitting period, a locking down mechanism 160 is provided and shown in FIG. 4, 5, 11 and 12. Mechanism 160 comprises a bracket 162 mounted on the wall 68 and comprising a locking solenoid 164 mounted on the bracket. The armature, as in the drive-engaging mechanism, is pivotally connected to a pin 166 about at the midpoint of a locking arm 168. The arm is pivoted to the bracket 162 as by a bolt 170, and one end of a spring 172 is attached to the pin 166. The other end of the spring is attached to an adjustable bolt 174 in a tapped opening 176 in an extension 178 from the bracket 162. By the spring 172 the locking arm 168 is biased in the unlocked position.

When the frame, driven by the motor 90, arrives at its lowermost position, the cross element 60 has its keeper 60a (FIG. 12) disposed beneath the level of the locking arm 168. At this point the frame engages a limit switch 180 (shown schematically in FIGS. 4, 5) which, through circuitry to be generally described, energizes the solenoid 164 to slam the arm 168 into locking position shown in full lines in FIG. 12. Because the solenoid 168 is a DC solenoid, it can remain silently activated during the course of table tennis play, all the while holding down the frame and net 56.

At the termination of play, because the target score is met by the participants or because of elapsed time, the control circuit deactivates the solenoid 164 and activates the reversible motor 90 to raise the frame 48. When the frame reaches its upper limit, that is, the play-preventing position, the cross element 60 will engage and snap over the latches 134, as described, and simultaneously engage the upper limit switch, shown very symbolically at 182 will, through the circuitry to be described, deactivate the motor 90 so that the frame and net 56 are properly held in play-preventing position. The limit switch 182 may be mounted on a wall 66, 68, or on the top wall 70 or suitable bracket within the control housing.

Figure 13:
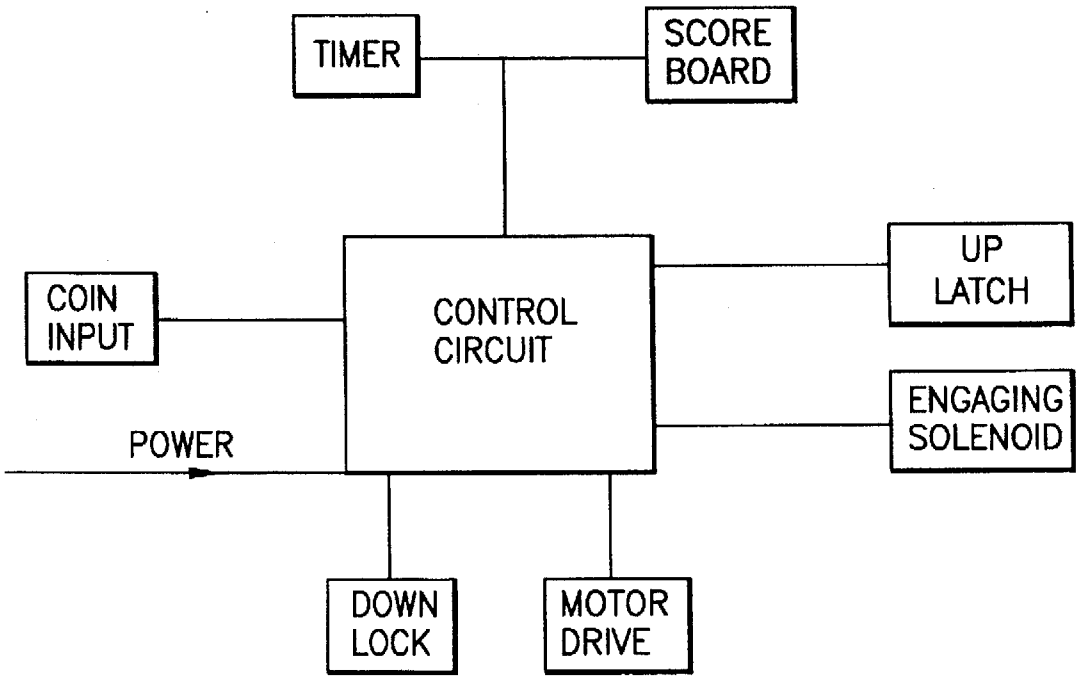
FIG. 13 is a very schematic chart of the components and circuitry involved.

FIG. 13 is a very general chart showing some of the components as they relate to the control circuit which is normally positioned behind the coil\n operators 42 and other controls on the end of the control housing.

The nature of the components have already been described. A typical sequence of operation will now be illustratively enumerated.

The normal position of the frame and net is in the play-preventing up position. At this point the two latches 134, spring-driven, are tucked under the cross element 60 to hold the net and frame upward. In this position, the frame, which may be embellished with an advertising panel thereon, is in its upward position.

The cycle of operation is initiated by the insertion of a coin or paper money into the receiver 42. This activates the control circuit to energize the timer and the scoreboard indicator shown generally in Pigs. 4 and 5 to indicate the score. The score shown is continually changed by circuitry including handy switch buttons used by the participants.

Immediately the upper latching mechanism 130 is activated by solenoid 144 (FIG. 6) to withdraw the latch bolts 134 from under the cross element 60 (FIG. 7). Simultaneously, the motor 90 drive-engaging mechanism 98 (FIG. 8) is activated so that the rounded shoe 110 slams the horizontal element inward, the wheels 88 engaging respectively the side elements 50, 52 of the frame. (To assure traction, the elements 50, 52 may be coated with abrasive.) At the same instant, the motor 90 activates, driving the wheels to lower the frame 48 from the FIG. 4 to the FIG. 5 play-permitting position. At this point, the cross element 60 engages the limit switch 180 which, through the control circuit, stops the motor 90 and activates the locking down mechanism 160 solenoid 164 to forcefully drive the locking arm 168 over the dog 60*a* on the cross element 60. This condition obtains during the course of play. The solenoid 164 remains quietly activated holding the frame down.

Upon reaching the target score, or upon a lapsed time, depending on the setup of the circuit, the locking down solenoid 164 will be deactivated. The drive-engaging solenoid 102 will be activated to again cause the shoe 110 to move the horizontal element 84 toward the frame, the wheels 88 engaging the side elements 50, 52. Contemporaneously, the motor 90 will be activated to drive up the frame as the wheels 88 rotate.

Upon reaching the upper position, the cross element 60 will snap past the spring latches 134, so that the latches will extend under the cross element 60 and the frame and net 36 will be in the play-preventing position. At the same time a limit switch 182 will be engaged by the cross element 60 (FIG. 4). This will deactivate the motor 90 and the drive-engaging solenoid 102. The frame and net will thus be locked in the upper position until the cycle is started again.

As described, should the frame and net be in play-permitting position and there is an unauthorized or accidental interruption in the power supply, the drive-engaging solenoid 102 will be deactivated, permitting the yoke 80 to swing to vertical with the wheels 88 away from the side elements 50, 52. The locking down solenoid 164 will be de-energized, permitting the locking arm 168 to move to the dotted line position (FIG. 12) away from the dog 60*a*. The frame is then free to move and the cables 126 driven by the spring drum 130 will pull the frame upwardly to a position at which the latches 134 will again snap underneath the crosspiece 60 and hold the frame 48 and net 56 in the play-preventing position.

The circuitry should be readily developable by one skilled in the art. The invention is not in the circuitry, but in the arrangement of various components and their sequence of operation as described.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A selectively play-preventing table tennis table comprising:

a. a table surface having a slot across the center thereof in the usual net position, b. legs supporting the table surface, c. a vertically disposed barrier adapted to vertically reciprocate in the slot, and d. a control housing under the table including a drive for lowering the barrier to a lower position to permit play and for raising the barrier to an upper position to prevent play.

2. A table tennis table as claimed in claim 1 wherein the drive includes a spring-driven component.

3. A table tennis table as claimed in claim 2 wherein the component is a drum having an internal spring urging rotation in one direction and a cable is secured to the periphery of the drum and connected to the barrier to urge the barrier toward the upper position.

4. A table tennis table as claimed in claim 1 wherein a net is mounted on an upper end of the barrier and the net is in the usual playing position when the barrier is in the lower position.

5. A table tennis table as claimed in claim 1 wherein the drive is an electric motor and the control housing encloses an electric circuit for controlling the motor.

6. A table tennis table as claimed in claim 5 wherein a coin-operated switch initiates the electric circuit.

7. A table tennis table as claimed in claim 5 wherein the first drive further includes a drive shaft connected to the electric motor and movably mounted in the control housing, the shaft carrying a drive wheel, and a first solenoid connected to the electric circuit urges the shaft into a position in which the wheel drivingly engages the barrier.

8. A table tennis table as claimed in claim 7 wherein a latch is mounted in the control housing to hold the barrier in the upper position and a second solenoid connected to the electric circuit retracts the latch prior to the motor driving the barrier to the lower position.

9. A table tennis table as claimed in claim 1 wherein a lock bolt is mounted in the control housing to hold the barrier in its lower position and a third solenoid connected to the electric circuit extends the lock bolt during the time the barrier is in lower position.

10. A table tennis table as claimed in claim 9 wherein a timer terminates the extension of the lock bolt.

11. A table tennis table as claimed in claim 1 wherein the table surface is divided into two halves at the slot and the legs include a central horizontal wheeled pedestal including a pair of parallel rails disposed lengthwise of the table and linkages pivoted to the pedestal on opposite sides of the rails respectively, and extending up to pivotal attachments adjacent the midpoint of the table surface halves respectively.

12. A table tennis table as claimed in claim 11 wherein the table surface halves can be pivoted about the respective attachments downward in the center of the table.

13. A table tennis table as claimed in claim 12 wherein the control housing rides on the rails and can be selectively shifted on the rails to avoid interference with the downward moving surface halves at the center of the table.

* * * * *